US005270901A

United States Patent [19]

Nowak et al.

[11] Patent Number: 5,270,901

[45] Date of Patent: Dec. 14, 1993

[54] CHARGE-DISSIPATING PACKAGING SYSTEM

[75] Inventors: Michael T. Nowak, Gardner, Mass.; Thomas E. Lewis, E. Hampstead, N.H.

[73] Assignee: Presstek, Incorporated, Hudson, N.H.

[21] Appl. No.: 789,751

[22] Filed: Nov. 8, 1991

[51] Int. Cl.[5] ..... H05F 3/00

[52] U.S. Cl. ..... 361/212; 361/220; 206/328

[58] Field of Search ..... 206/328; 361/212, 220, 361/396, 412, 415, 424

[56] References Cited

U.S. PATENT DOCUMENTS

| | | | |
|---|---|---|---|
| 3,768,227 | 10/1973 | Grisell | 361/212 |
| 4,160,503 | 7/1979 | Ohlbach | 206/328 |
| 4,241,829 | 12/1980 | Hardy | 206/328 |
| 4,404,615 | 9/1983 | Dep | 361/212 |
| 4,480,747 | 11/1984 | Kazor et al. | 206/334 |
| 4,528,222 | 7/1985 | Rzepecki et al. | 428/35 |
| 4,593,339 | 6/1986 | Robinson | 361/220 |
| 4,677,809 | 7/1987 | Long et al. | 53/427 |
| 4,684,020 | 8/1987 | Ohlbach | 206/328 |
| 4,685,563 | 8/1987 | Cohen et al. | 206/328 |
| 4,706,438 | 11/1987 | Ohlbach | 53/410 |
| 4,798,290 | 1/1989 | Bradford | 206/328 |
| 4,883,172 | 11/1989 | Young | 206/328 |
| 4,889,750 | 12/1989 | Wiley | 428/34.2 |
| 4,909,901 | 3/1990 | McAllister et al. | 162/125 |
| 4,966,280 | 10/1990 | Bradford | 206/328 |
| 5,012,924 | 5/1991 | Murphy | 361/220 |
| 5,014,849 | 5/1991 | Becker | 206/328 |
| 5,017,260 | 5/1991 | Bardford | 156/30.8 |
| 5,170,328 | 12/1992 | Kruppa | 361/212 |

*Primary Examiner*—Jeffrey A. Gaffin
*Attorney, Agent, or Firm*—Cesari and McKenna

[57] ABSTRACT

An enclosure system for storage of electrostatically active, planar articles such as spark-discharge recording media. The enclosure includes a container portion, which defines a cavity for containing the articles and is conductive on all surfaces; and a nonconductive lid that fits over the container. In one embodiment, the enclosure cooperates with a set of interleaving sheets that a user places between the articles, and which make contact both with charged surfaces of the individual articles and the conductive interior of the container. In another embodiment, the interleaving sheets are integral with the article itself, thereby ensuring separation of each article from the one underneath by a layer capable of conveying electrostatic charge to the container.

7 Claims, 2 Drawing Sheets

CHARGE-DISSIPATING PACKAGING SYSTEM

BACKGROUND OF THE INVENTION

A. Field of the Invention

This invention relates generally to packaging, and more particularly to a container for storing stacks of planar, charge-storing materials.

B. Description of the Related Art

Recording media and graphic arts products such as lithographic printing plates often take the form of planar laminates, and may include one or more metal layers sandwiched between dielectric material (such as polymer sheets). As such laminate media are handled and prepared for packaging, their dynamic motion through air can generate sufficient friction to produce an electrostatic charge on the exposed dielectric layer or layers. That charge accumulates and is stored on the metal layers as the laminates are stacked, forming a multilevel charged capacitor. Depending on the dimensions of the laminates, the accumulated charge and corresponding voltage can become significant. Consequently, personnel handling the stacked materials can be exposed to discomfort or even physical danger if their actions result in simultaneous contact with two or more metal plates.

Dissipation of electrostatic charge from packaged goods has long been a concern in the semiconductor industry, where charge-sensitive devices can be damaged during handling, transit and storage unless appropriate measures are taken. These measures typically involve the design of special shipping containers that prevent voltage buildup by conducting charge from the terminals of devices packed within the containers to the exteriors thereof. Any excess charge either circulates until it decays to a harmless value or bleeds off to ground when the containers are placed on grounded surfaces.

Because such containers are designed for small electrical components, the necessary electrical connections can be established by inserting the components' terminals into conductive foam that is itself electrically coupled to conductive exterior surfaces of the container. Such a configuration is unsuitable for many types of stacked laminates, however, since charge dissipation from such articles requires electrical contact with the conductive layers thereof; it is impossible to achieve the intimate contact afforded by mechanical insertion.

Exacerbating the difficulty of establishing a good electrical connection between stacked graphic-arts laminates and a container is the fact that such laminates often consist of layers that are quite thin, so that the edges of conductive layers cannot provide adequate surface area to establish strong electrical contact. This problem becomes even more acute with respect to laminates that contain extremely thin aluminum layers, such as spark-imaged lithographic printing plates. Although such layers can store significant charge if their surface areas are large, their edges are prone to formation of a nonconductive oxide layer. This further reduces the electrical effect of whatever contact the edges of such thin layers can make with opposing surfaces of the walls. Accordingly, traditional charge-dissipating container designs that might be modified to make contact with the edges of stacked articles will not prove suitable for graphic-arts applications.

DESCRIPTION OF THE INVENTION

A. Brief Summary of the Invention

The present invention provides a charge-dissipating enclosure for a stack of flat articles. The enclosure includes a container portion, which defines a cavity for containing the articles and is conductive on all surfaces; and a nonconductive lid that fits over the container. In one embodiment, the enclosure cooperates with a set of conductive interleaving sheets that a user places between the articles as they are introduced into the container portion. These sheets thereby make contact with charged surfaces of the individual articles, and are sufficiently thick that contact between their edges and the conductive interior surfaces of the container spreads the charge over all surfaces of the container. Placing the container on a grounded surface then bleeds the charge from the container and, hence, from the articles therein.

In another embodiment, the interleaving sheets are integral with the laminated article itself, thereby ensuring separation of each article from the one underneath by a layer capable of conveying electrostatic charge to the container. In this case, the interleaving sheets should exhibit not only adequate thickness and conductivity, but also sufficiently low adhesion to the article layer immediately beneath to facilitate its ready removal (e.g., by peeling).

B. Brief Description of the Drawings

For a fuller understanding of the nature of the invention, reference should be had to the following detailed description taken in connection with the accompanying drawings, in which.

C. Detailed Description of the Invention

Figure 1:
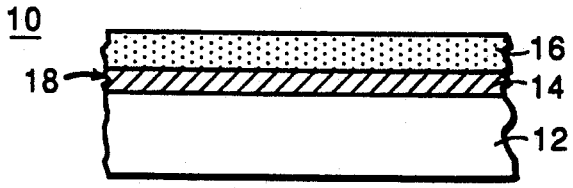
FIG. 1 is a sectional view of a representative laminate article.

The invention will be described with reference to the representative laminate article shown in FIG. 1. That article, a lithographic plate blank indicated generally by reference numeral 10, includes a dielectric substrate 12 having a thickness of approximately 0.0005 to 0.01 inch; a conductive aluminum layer 14 from about 200 to about 700 Å thick; and a partially conductive, pigment-loaded silicone overlayer 16 on the order of 0.0001 and 0.002 inch thick. A more detailed description of this type of plate may be found in U.S. Pat. No. 5,109,771, the entire disclosure of which is hereby incorporated by reference. When this article is subjected to conditions that result in production of an electrostatic charge, the charge ordinarily accumulates on substrate 12 and induces a corresponding potential difference between that surface and the metallic top layer 14.

When the plate blank is laid atop a second, similarly charged blank, the potentials add, so that the overall voltage produced by stacking a series of such plates can become considerable. However, because of its minuscule thickness, the edge 18 of aluminum layer 14 cannot easily make electrical contact with a surface adjacent thereto, so traditional forms of conductive packaging would fail to dissipate the accumulating potential.

Figure 2:
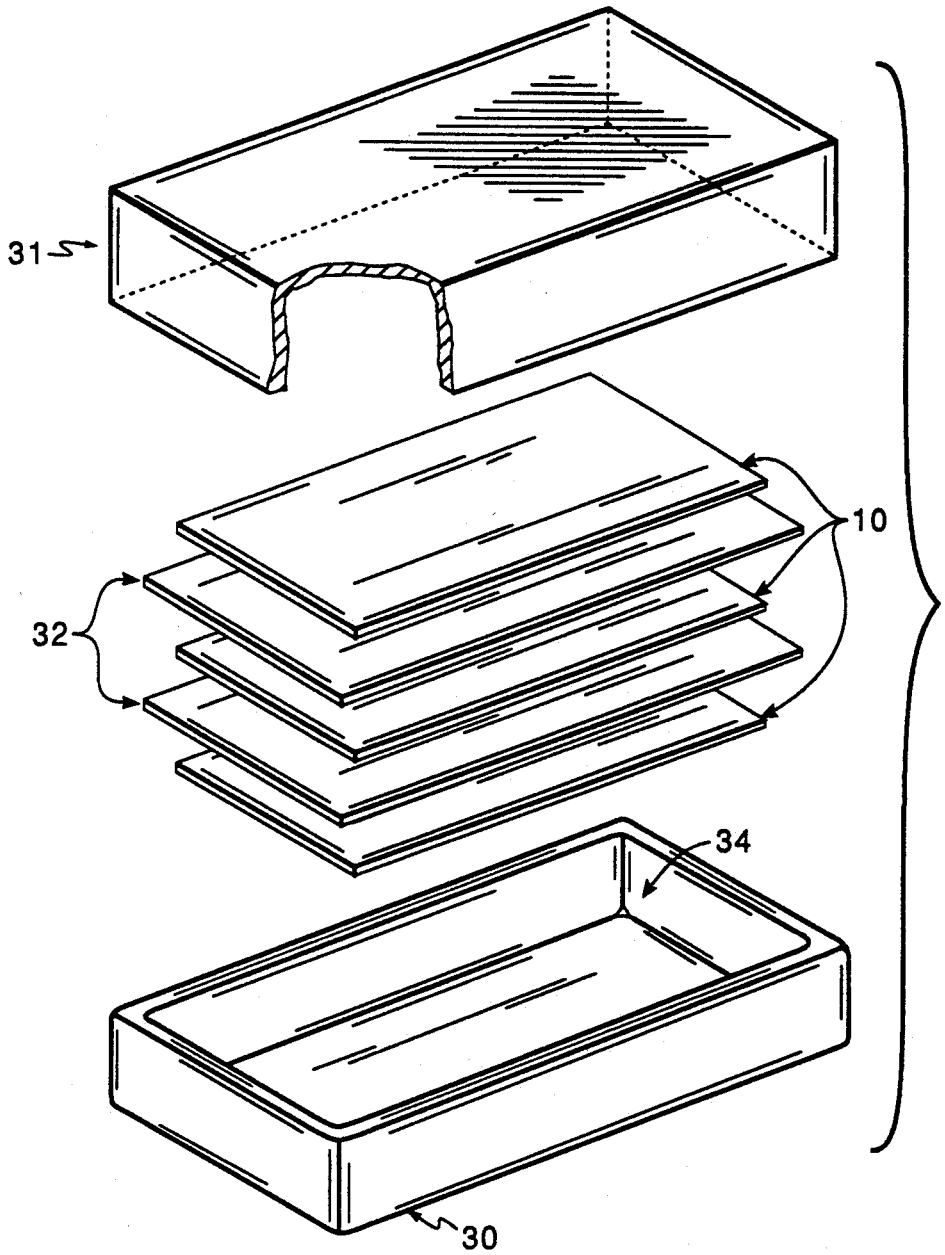
FIG. 2 is an exploded view of the components of the present invention and a series of laminate articles.

In a first embodiment, the present invention encompasses a system for housing a stack of articles, such as the plate shown in FIG. 1, that are capable of accumulating and storing an electrostatic charge. The system includes an enclosure, shown fully in FIG. 2, and a series of conductive interleaving sheets (which will be described in greater detail below). The enclosure comprises a container portion 30 and a lid member 31, which fits over container 30. Container 30 is conductive on all of its surfaces and defines a cavity 34 in which the articles are stacked. It may be fabricated from ordinary paperboard to which foil is cemented or otherwise bonded, or from sturdy volume conductive material (e.g., paperboard impregnated with relatively large amounts of carbon).

Figure 3:
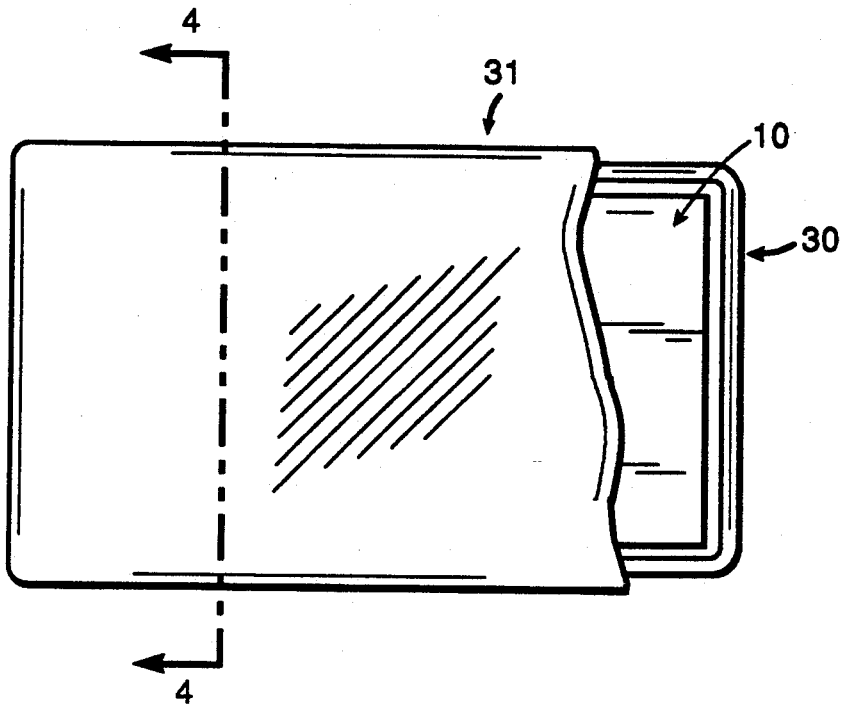
FIG. 3 is a cutaway plan view of the present invention, showing laminate articles within the container portion thereof.
Figure 4:
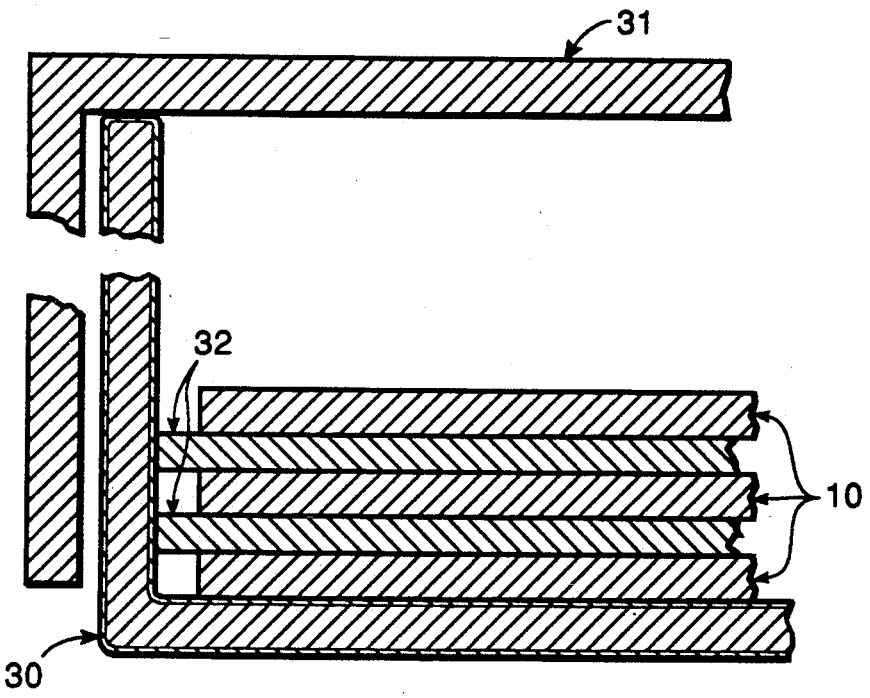
FIG. 4 is a sectional view of the components of the present invention, taken along line 3—3 of FIG. 4.

Refer now to FIG. 4, which is a cross-sectional detail of the system as it appears in use. Lodged between plates 10 stacked in the cavity of container 30 are a series of interleaving sheets 32. These sheets conduct charge from the underside of each plate to the interior surface of container 30; for visual clarity, the plates 10 are shown in FIG. 3 as single-layered monoliths, but it should be understood that each such plate contains the layers shown in FIG. 1.

Preferred materials for sheets 32 are carbon-filled conductive papers (e.g., the black conductive paper marketed by CPM Inc., Claremont, N.H., under the name CPM TR 406 S) or conductive film (e.g., the polyimide film marketed by E.I. duPont de Nemours Company, Wilmington, Del. under the name KAPTON, or the carbon-black-filled conductive polycarbonate film marketed by Mobay Corp., Pittsburgh, Pa. under the name Makrofol Trial Product KL3-1009). The primary considerations regarding choice of material are sufficient thickness (preferably at least 0.0005 inch), conductivity and cost effectiveness; at the present time, conductive papers represent the least expensive alternative.

The planar dimensions of each sheet can exceed those of the stacked articles so that, as shown in FIG. 4, the edges of the sheets press directly against the interior walls of container 30. With this approach, it is possible to employ even relatively thin (e.g., 0.0005 to 0.002 inch) and inexpensive materials such as polyolefin or polyester that have been vacuum metallized on both sides, since contact with the interior container walls is not limited to the thin edges. However, the materials discussed in the preceding paragraph, being volume conductive, can be employed in dimensions approximately equal to those of the stacked articles. In this case, it appears that the sheets maintain sufficient contact with the walls as the stack is agitated during handling.

In an alternative approach, the interleaving sheets can be integral with the stacked materials themselves. For example, in U.S. Pat. No. 5,188,032, the entire disclosure of which is hereby incorporated by reference, we describe lithographic plate constructions that include protective barrier sheets. These sheets protect underlying layers from abrasion and other forms of damage, and are peeled off the plate when it is ready for use. Such barrier sheets can be rendered conductive (e.g., by impregnation with conductive pigment such as carbon black) and applied at sufficient thickness to serve the function of the interleaving sheets. However, the adhesion between the barrier material and the layer immediately beneath should be sufficiently weak that the barrier sheet can be conveniently peeled away or otherwise removed.

The shape and configuration of the enclosure is not critical. The lid-and-container design was chosen for convenience, but alternative constructions will be apparent to the skilled practitioner.

Thus, it will be seen that we have provided a charge-dissipating enclosure system that is uniquely suited to storage of electrostatically active, planar material. Furthermore, the terms and expressions which have been employed are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A charge-dissipating system for housing a stack of flat articles each having a planar dimension and which are prone to electrostatic charge accumulation, the system comprising:
   a. a container conductive on its interior and exterior surfaces; and
   b. a plurality of conductive interleaving sheets having planar dimensions that at least match those of flat articles to be stacked in the container and which, when introduced between such articles, electrically connect such articles to the interior surface of the container.

2. The system of claim 1 further comprising a lid adapted to fit over the container.

3. The system of claim 1 wherein the interleaving sheets are at least 0.0005 inch thick.

4. The system of claim 1 wherein the planar dimensions of the interleaving sheets substantially match the dimensions of the interior surfaces of the container such that placement of a sheet within the container results in contact between the edges of the sheet and the interior surface of the container.

5. The system of claim 1 wherein the planar dimensions of the interleaving sheets substantially match those of the articles.

6. The system of claim 1 wherein the interleaving sheets are integral with the articles.

7. The system of claim 1 wherein the interleaving sheets are separate from the articles.

* * * * *